US009728910B2

(12) United States Patent
Lee

(10) Patent No.: US 9,728,910 B2
(45) Date of Patent: Aug. 8, 2017

(54) COAXIAL CONNECTOR

(71) Applicant: SOLID, INC., Gyeonggi-do (KR)

(72) Inventor: Dong Won Lee, Gyeonggi-do (KR)

(73) Assignee: SOLiD, INC., Seongnam-si (KR)

( * ) Notice: Subject to any disclaimer, the term of this patent is extended or adjusted under 35 U.S.C. 154(b) by 0 days.

(21) Appl. No.: 14/411,480

(22) PCT Filed: Apr. 15, 2014

(86) PCT No.: PCT/KR2014/003262
§ 371 (c)(1),
(2) Date: Dec. 26, 2014

(87) PCT Pub. No.: WO2015/156440
PCT Pub. Date: Oct. 15, 2015

(65) Prior Publication Data

US 2017/0018891 A1 Jan. 19, 2017

(30) Foreign Application Priority Data

Apr. 8, 2014 (KR) ..... 10-2014-0041795

(51) Int. Cl.

| | |
|---|---|
| ***H01R 24/40*** | (2011.01) |
| ***H01R 24/38*** | (2011.01) |
| ***H01R 13/508*** | (2006.01) |
| ***H01R 13/52*** | (2006.01) |
| *H01R 103/00* | (2006.01) |

(52) U.S. Cl.
CPC ..... *H01R 24/38* (2013.01); *H01R 13/508* (2013.01); *H01R 13/5219* (2013.01); *H01R 24/40* (2013.01); *H01R 2103/00* (2013.01)

(58) Field of Classification Search
CPC ..... H01R 13/6315; H01R 24/50; H01R 24/40
USPC ..... 439/247, 248, 63, 581
See application file for complete search history.

(56) References Cited

U.S. PATENT DOCUMENTS

| | | | | | |
|---|---|---|---|---|---|
| 4,227,765 | A | * | 10/1980 | Neumann | H01R 24/52 439/248 |
| 4,697,859 | A | * | 10/1987 | Fisher, Jr. | H01R 13/6315 439/246 |
| 5,329,262 | A | * | 7/1994 | Fisher, Jr. | H01R 13/6315 333/260 |
| 5,516,303 | A | * | 5/1996 | Yohn | H01R 13/6315 439/248 |

(Continued)

FOREIGN PATENT DOCUMENTS

| | | |
|---|---|---|
| KR | 10-2005-0077512 | 8/2005 |
| KR | 10-2007-0073831 | 7/2007 |

OTHER PUBLICATIONS

International Search Report issued in PCT/KR2014/003262 mailed Apr. 15, 2014.
Written Opinion issued in PCT/KR2014/003262 mailed Jan. 6, 2015.

*Primary Examiner* — Gary Paumen
(74) *Attorney, Agent, or Firm* — Sughrue Mion, PLLC

(57) ABSTRACT

The present invention relates to a coaxial connector. According to the present invention, there is provided a coaxial connector which is installed for electrical connection of a communication module, and includes a first connector in which an insulator through which a conductor penetrates is installed inside a first housing, and a conductive gasket is seated between the first housing and the insulator; and a second connector which is coupled so that a front end comes into close contact with the conductive gasket.

10 Claims, 4 Drawing Sheets

(56) References Cited

U.S. PATENT DOCUMENTS

| | | | | |
|---|---|---|---|---|
| 5,769,652 | A * | 6/1998 | Wider | H01R 24/50 439/248 |
| 6,224,390 | B1 * | 5/2001 | Mitani | H01R 13/6315 439/63 |
| 6,699,054 | B1 * | 3/2004 | Critelli | H01R 13/6315 439/248 |
| 7,422,456 | B1 * | 9/2008 | Mitani | H01R 13/6315 439/247 |
| 7,828,595 | B2 * | 11/2010 | Mathews | H01R 9/0524 439/578 |
| 7,833,053 | B2 * | 11/2010 | Mathews | H01R 9/0524 439/578 |

* cited by examiner

COAXIAL CONNECTOR

TECHNICAL FIELD

The present invention relates to a coaxial connector, and more particularly, to a coaxial connector having a structure in which connection characteristics between a first connector and a second connector are improved and improved PIM performance can be obtained.

BACKGROUND ART

As a method for interfacing RF input/output signals in a communication device with each other, a SMA type connector, an N type connector, a DIN type connector and the like are widely used. Usually, one of such common connectors is selectively used in consideration of the size and the RF output power. Since the SMA type has a small size, it occupies less space and it is easily fastened even in a narrow space. However, it has a problem of bad inter-modulation distortion characteristics (hereinafter, referred to as PIM). Meanwhile, the N-type has excellent PIM characteristics, but since it has a larger size than the SMA type, it will occupy a lot of space, and there is also a need to spend a wider space for tightening. Although the DIN type also has the most excellent PIM characteristics, the spatial utilization is not further easier due to an increase in size as much.

Since the environment that requires the PIM characteristics further increases with an increase in the frequency of use, in order to satisfy these PIM characteristics, it is the right choice to use the DIN type. However, it has a problem that occupies a lot of space as described above. Also, as decreases in the weight/size of the communication devices progress, spatial issues caused by conventional thread-fastening type connectors have become more sensitive matters, and have caused inconveniences to be used on the user side.

In addition to the PIM characteristics, as the factors that become restrictions on the use of the plug-in connector, there are isolation characteristics and the like. For example, in an ICS repeater, the interference between the forward and reverse signals generated in the apparatus gives a very sensitive affect on the ICS performance of the device. However, in the case of the plug-in connector, since the isolation characteristics are greatly lower than the thread-fastening type connector, for some of the connections between modules, there are restrictions on the application, and thus, it has not been possible to solve the spatial problems and the inconvenience for use.

DISCLOSURE

Technical Problem

Therefore, in order to solve the above-described problems of the prior art, an object of the present invention is to provide a coaxial connector having a structure in which connection characteristics between the first connector and the second connector are improved and the improved PIM performance can be obtained.

Technical Solution

According to an aspect of the present invention for achieving the above-described object, a coaxial connector according to the present invention is a coaxial connector which is installed for electrical connection of a communication module, wherein the coaxial connector includes a first connector in which an insulator through which a conductor penetrates is installed inside a first housing, and a conductive gasket is seated between the first housing and the insulator; and a second connector which is coupled so that a front end comes into close contact with the conductive gasket, and the second connector can include a second housing that is fixedly installed in the communication module; a moving housing which is movably coupled to the inside of the second housing, and a leading end of which comes into close contact with the conductive gasket; and a bushing that is movably provided between the second housing and the moving housing to support a rear end of the moving housing.

According to another aspect of the present invention, a coaxial connector according to the present invention is a coaxial connector which is installed for electrical connection of a communication module, wherein the coaxial connector includes a first connector in which an insulator through which a conductor penetrates is installed inside a first housing, and a conductive gasket is seated between the first housing and the insulator; and a second connector which is coupled so that a front end comes into close contact with the conductive gasket, and the second connector can include a second housing that is fixedly installed in the communication module; a moving housing which is coupled to the inside of the second housing so as to be movable forward and backward, and a leading end of which comes into close contact with the conductive gasket; and an elastic member that is installed between the second housing and the moving housing to elastically support a rear end of the moving housing.

A stopping member may be formed on an outer surface of the moving housing, and a leading end of the second housing is stopped by the stopping member.

A front end of the moving housing may be formed so as to come into contact with only a part of a contact area of the conductive gasket.

A tapered portion may be formed on the inside of the front end of the moving housing, and a width of the tapered portion becomes wider as it goes forward.

A tapered portion may be formed on the inside of the rear end of the first housing, and a width of the tapered portion becomes wider as it goes rearward.

A fastening block may be provided at the rear end of the second housing, and the moving housing is installed on the fastening block to be movable back and forth.

It should be understood that different embodiments of the invention, including those described under different aspects of the invention, are meant to be generally applicable to all aspects of the invention. Any embodiment may be combined with any other embodiment unless inappropriate. All examples are illustrative and non-limiting.

Advantageous Effects

According to the present invention, it is possible to obtain an improved PIM performance by improved connection characteristics between the first connector and the second connector coupled through the conductive gasket, and at the same time, it is possible to improve the user's operational convenience by solving the spatial issue.

Also, since it is possible to compensate for the assembly tolerances in the process in which the second connector is coupled by a bushing or an elastic member, coupling between the first connector and the second connector can be softly and tightly performed.

BEST MODE FOR THE INVENTION

Figure 1:
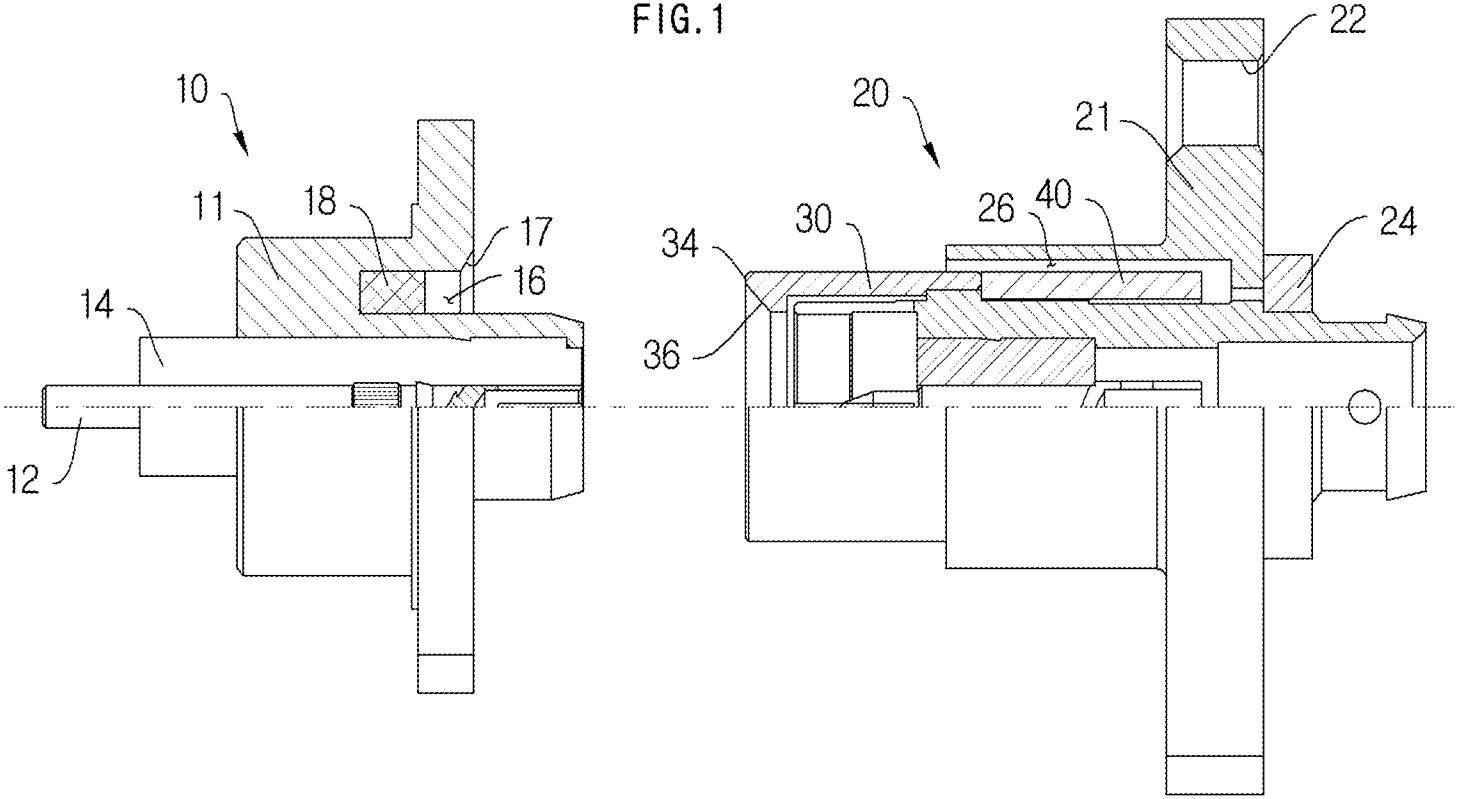
FIG. 1 is a side view showing that a coaxial connector according to an embodiment of the present invention is partially cut away in a disconnected state.

Exemplary embodiments of the present invention will be described below in more detail with reference to the accompanying drawings. The present invention may, however, be embodied in different forms and should not be construed as limited to the embodiments set forth herein. Rather, these embodiments are provided so that this disclosure will be thorough and complete, and will fully convey the scope of the present invention to those skilled in the art. Throughout the disclosure, like reference numerals refer to like parts throughout the various figures and embodiments of the present invention.

The terms used in this application are used to merely describe particular embodiments, and are not intended to limit the present invention. Expressions of the singular numbers include the expressions of the plural numbers unless they are obviously differently expressed in the context. In the present application, it should be understood that the terms, such as "comprising" or "having" are described in the specification features, are intended to specify the presence of characteristics, numbers, steps, operations, components, parts, and a combination thereof, but do not previously exclude the possibilities of the presence or addition of one or more other characteristics, numbers, steps, operations, components, parts, and a combination thereof.

Hereinafter, an embodiment of a coaxial connector according to the present invention will be described in detail with reference to the attached drawings.

Figure 2:
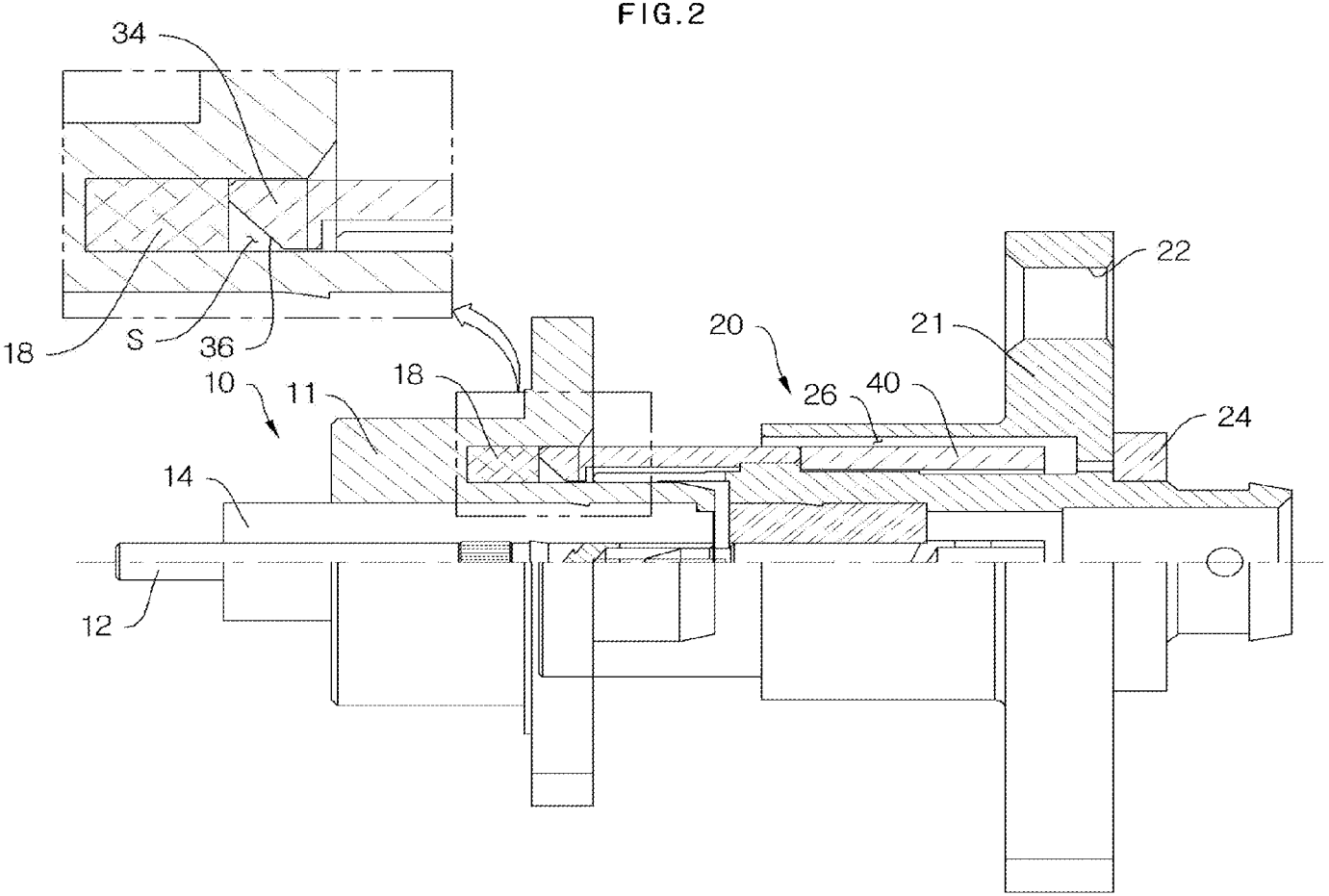
FIG. 2 is a side view showing that the coaxial connector according to an embodiment of the present invention is partially cut away in a coupled state.

FIG. 1 is a side view showing that a coaxial connector according to an embodiment of the present invention is partially cut away in a disconnected state, and FIG. 2 is a side view showing that the coaxial connector according to an embodiment of the present invention is partially cut away in a coupled state.

According to the shown configuration, the coaxial connector according to the present invention is a coaxial connector installed for electrical connection of a communication module, wherein the coaxial connector can include a first connector 10 in which an insulator 14 through which a conductor 12 penetrates is installed inside a first housing 11, and a conductive gasket 18 is seated between the first housing 11 and the conductor 14; and a second connector 20 coupled so that a front end come into close contact with the conductive gasket 18.

In this embodiment, the coaxial connector is generally formed by coupling between the first connector 10 and the second connector 20. The first connector 10 and the second connector 20 are installed in the communication module in a state of being coupled together, and is coupled to the plug-in port to act to ensure that the electrical connection necessary for a power source and signal of the communication module is made.

The first connector 10 has a shape of a female connector, the second connector 20 has a shape of a male connector, and the coupling is performed while the second connector 20 is inserted into the first connector 10.

The first housing 11 is constituted by an approximately hollow cylinder, and a flange extending radially from the outer surface of the cylinder. An insulator 14 is installed in the hollow portion of the first housing 11, and the flange of the first housing 11 can be coupled to one side of the communication module. Moreover, the conductor 12 is placed through the inside of the insulator 14.

In addition, a gasket accommodating groove 16 for accommodating the conductive gasket 18 is formed inside the first housing 11. The gasket accommodating groove 16 is formed to be recessed by a predetermined depth toward the front from the rear end of the first housing 11. Therefore, the contact is made while the second connector 20 presses the conductive gasket 18, whereby it is possible to obtain the improved PIM (inter-modulation distortion signal) performance compared to a plug-in connector having a general structure, while the connection characteristics of the first and second connectors 10 and 20 are improved.

On the rear end inside of the first housing 11 formed with the gasket accommodating groove 16, a tapered portion 17 can be formed so as to allow the moving housing 30 to be smoothly inserted. The tapered portion 17 is formed to be wider in width as it goes backward. In this way, by forming the tapered portion 17, it is possible to minimize the tolerances of the diameter of the contact portion between the first housing 11 and the moving housing 30, the effect of enhancing the performance can be obtained, and at the same time, the smooth fastening can be made.

The coaxial connector is used for interface between the communication modules implemented within the communication device, at this time, while the coaxial connector protrudes to the outside of the communication module, the space in accordance with the tolerances is formed around it, and electromagnetic waves that affect the performance of the apparatus leak out. Otherwise, when the two coaxial connectors are fastened, since a space is also present between the coupling portions of the coaxial connectors, the electromagnetic waves leak out as described above. Furthermore, the isolation and grounding performances are lowered due to a lack of the contact area between the coaxial connectors, which fails to obtain the desired performance.

In this embodiment, in order to improve the degradation of performance, the conductive gasket 18 is provided at the coupling portion between the first connector 10 and the second connector 20. When the coupling of both is performed via the conductive gasket 18, the isolation and grounding performances may be improved, and the operator can obtain the enough performance.

Similar to the first housing 11, the second housing 21 forming an external form of the second connector 20 is also constituted by an approximately hollow cylinder, and a flange extending radially from the outer surface of the cylinder. In the flange portion of the second housing 21, a fastening hole 22 for being fastened to the communication module is formed. Moreover, a fastening ring 24 is provided at the rear end of the second housing 21. Although the fastening ring 24 is shown as a separate configuration from the second housing 21 in FIG. 1, it is not necessarily limited thereto, and the fastening ring 24 may be formed integrally with the second housing 21. Also, a bushing groove 26 for accommodating the bushing 40 is formed inside the second housing 21.

The moving housing 30 is coupled to the inside of the fastening ring 24. At this time, the moving housing 30 is not fixedly coupled to the fastening ring 24, and it can be coupled, for example, by an interference fit. Thus coupled moving housing 30 can move back and forth by the external force. Of course, the moving housing 30 can also be vertically moved. Moreover, the front end 34 of the moving housing 30 is a portion which directly come into contact with the conductive gasket 18 when being coupled to the first connector 10. Since the moving housing 30 has a generally hollow cylindrical shape, the front end 34 of the moving housing 30 has an approximately ring shape.

Meanwhile, in this embodiment, the front end 34 of the moving housing 30 can be formed so as to come into contact with only a part of the contact area of the conductive gasket 18. In other words, the whole contact area of the conductive gasket 18 opposite to the front end 34 of the moving housing 30 does not come into contact with the front end 34 of the moving housing 30, and only a part of the contact area of the conductive gasket 18 come into contact with the front end 34 of the moving housing 30. By such a configuration, when the conductive gasket 18 and the front end 34 of the moving housing 30 come into contact with each other over the entire surface, a lot of repulsive force occurs. When a lot of repulsive force occurs in this way, the first connector 10 and the second connector 20 may not be firmly coupled to each other. Thus, in this embodiment, by configuring so that the front end 34 of the moving housing 30 does not come into contact with the conductive gasket 18 over the entire surface, a space S is formed to allow the conductive gasket 18 to get out by the repulsive force.

Also, on the inside of the front end 34 of the moving housing 30, a tapered portion 36 may be formed to have a width that becomes wider as it goes forward. This is obtained machine the front end 34 of the moving housing 30 so as to prevent the front end 34 of the moving housing 30 from coming into contact with the conductive gasket 18 over the entire surface.

Meanwhile, the bushing 40 is installed to be movable back and forth between the second housing 21 and the moving housing 30. The bushing 40 supports the rear end of the moving housing 30. Moreover, since the bushing 40 can move back and forth in a state of being seated in the bushing groove 26, it is possible to compensate for tolerances of the coupling length in the axial direction of the coaxial connector. That is to say, assembly failure may occur due to the tolerances that occur in the process of machining and assembling the first connector 10 and the second connector 20. At this time, since the bushing 40 is installed to be able to move back and forth, it is possible to compensate for an occurrence of play in the moving housing 30 coupled to the second housing 21 in the axial direction due to the tolerance. For reference, although it has been described that the bushing 40 can move back and forth, it is a fine movement in which the moving distance is about 1 mm.

Next, another embodiment of the second connector according to the present invention will be described below with reference to FIG. 3. For reference, the detailed descriptions of the same configurations as those of the above-described embodiments will not be provided for convenience.

Figure 3:
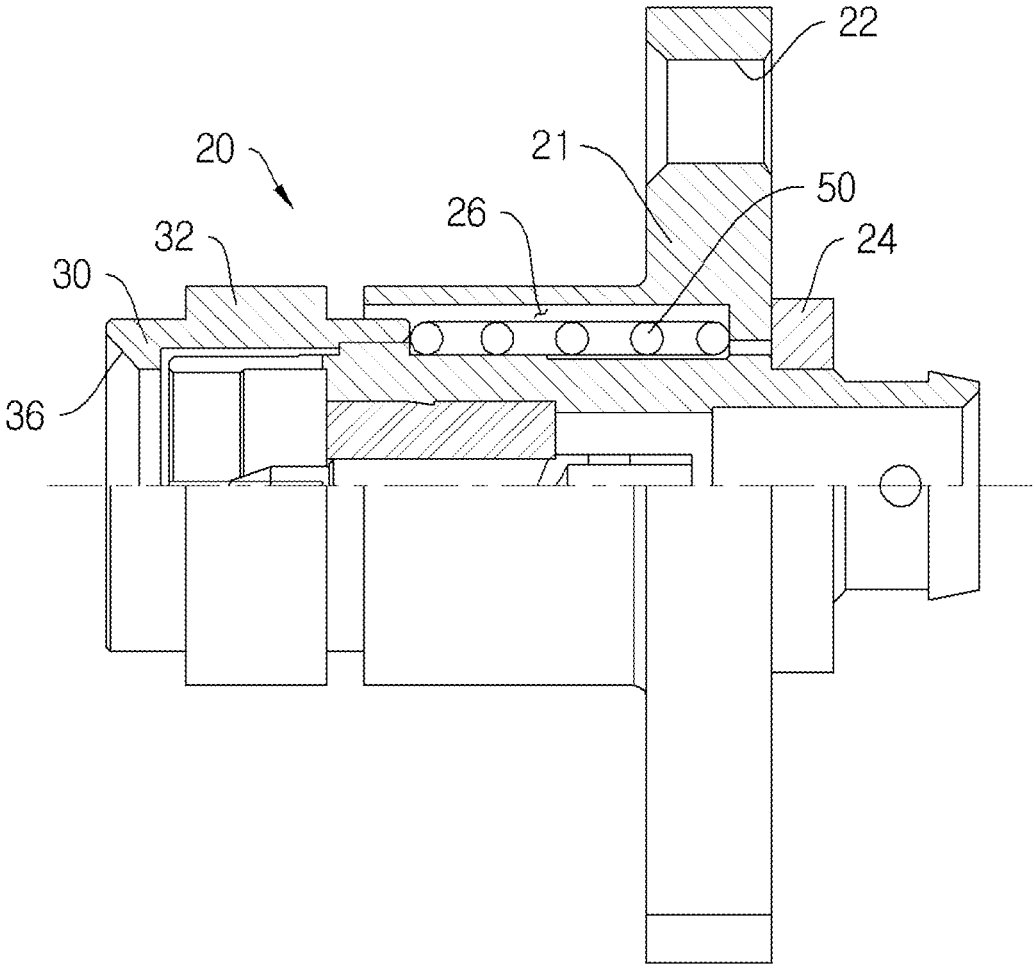
FIG. 3 is a side view showing another embodiment of a second connector according to the present invention.

Referring to FIG. 3, in this embodiment, the configuration of the second connector 20 is substantially the same as the above-described embodiment. However, in the present embodiment, as a configuration for compensating for the tolerances that occur during the assembly of the first connector 10 and the second connector 20, an elastic member 50 is adopted in place of the bushing 40. The elastic member 50 is installed between the moving housing 30 and the second housing 21, and serves to support the rear end of the moving housing 30. The elastic member 50 has the advantage of being able to more flexibly compensate for the assembly tolerances than the bushing 40.

Also, in this embodiment, a stopping member 32 can be formed on the outer surface of the moving housing 30. When the stopping member 32 is formed, since the front end of the second housing 21 is stopped by the stopping member 32, it is possible to properly keep the engagement interval between the second housing 21 and the moving housing 30.

Next, another embodiment of the second connector according to the present invention will be described below with reference to FIG. 4.

Figure 4:
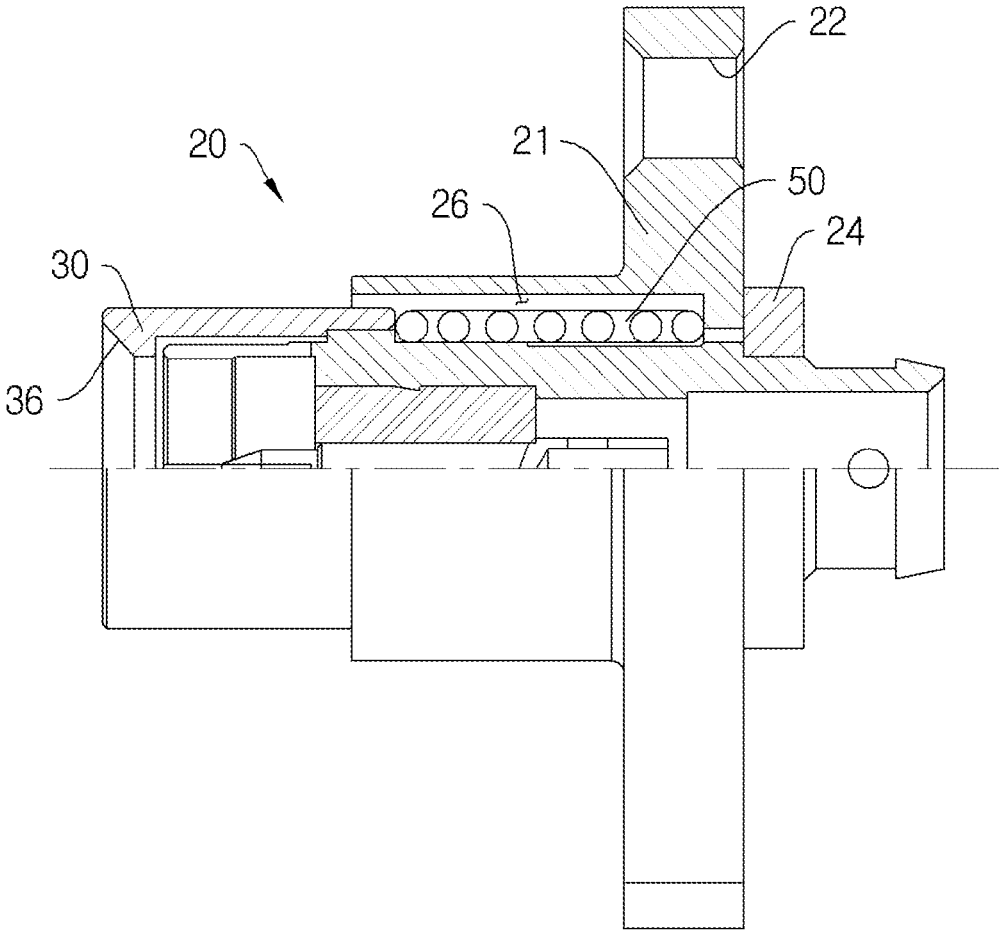
FIG. 4 is a side view showing still another embodiment of the second connector according to the present invention.

Referring to FIG. 4, in this embodiment, unlike the above-described embodiments, the catching claw 32 is not formed on the outer surface of the moving housing 30. Instead, in this embodiment, the elastic force of the elastic member 50 is adjusted to be greater than the insertion force of the second connector 20 and the repulsive force of the conductive gasket 18 so as to maintain the fastening interval.

While the embodiments of the present invention have been described above in detail, the scope of the present invention is not limited to this, and various modified and improved forms of those skilled in the art utilizing the basic concepts of the invention as defined in the following claims also fall within the scope of the present invention.

While the present invention has been described with respect to the specific embodiments, it will be apparent to those skilled in the art that various changes and modifications may be made without departing from the spirit and scope of the invention as defined in the following claims.

The invention claimed is:

1. A coaxial connector that is installed for electrical connection of a communication module, comprising:

a first connector in which a conductive gasket is accommodated in a first groove, wherein the first groove is formed inside a first housing to be spaced apart from an insulator surrounded by the first housing; and a second connector which is configured to be coupled to the first connector such that a front end of the second connector is inserted into the first groove when the first connector and the second connector are coupled together, wherein the second connector comprises:

a second housing that is configured to be fixedly installed in the communication module;

a moving housing which is coupled to the second housing in a movable way, a front end of the moving housing contacting with a part of the conductive gasket when the first connector and the second connector are coupled together; and a bushing that is accommodated in a second groove formed inside the second housing in a movable way, and supports a rear end of the moving housing.

2. The coaxial connector of claim 1, wherein a stopping member is formed on an outer surface of the moving housing, and a front end of the second housing is stopped by the stopping member.

3. The coaxial connector of claim 1, wherein a tapered portion is formed on the front end of the moving housing, and a width of the tapered portion becomes wider toward the first connector.

4. The coaxial connector of claim 1, wherein a tapered portion is formed on the first groove, and a width of the tapered portion becomes wider toward the second connector.

5. The coaxial connector of claim 1, wherein a fastening block is arranged at a rear end of the second housing and is coupled to the moving housing in a way that makes the moving housing movable.

6. A coaxial connector which is installed for electrical connection of a communication module, comprising:

a first connector in which a conductive gasket is accommodated in a first groove, wherein the first groove is formed inside a first housing to be spaced apart from an insulator surrounded by the first housing; and a second connector configured to be coupled with the first connector such that a front end of the second connector is inserted is inserted into the first groove when the first connector and the second connector are coupled together, wherein the second connector comprises:

a second housing that is configured to be fixedly installed in the communication module;

a moving housing which is coupled to the second housing in a movable way, a front end of the moving housing contacting with a part of the conductive gasket when the first connector and the second connector are coupled together; and an elastic member that is accommodated in a second groove formed inside the second housing, and elastically supports a rear end of the moving housing.

7. The coaxial connector of claim 6, wherein a stopping member is formed on an outer surface of the moving housing, and a front end of the second housing is stopped by the stopping member.

8. The coaxial connector of claim 6, wherein a tapered portion is formed on an inside of the front end of the moving housing, and a width of the tapered portion becomes wider toward the first connector.

9. The coaxial connector of claim 6, wherein a tapered portion is formed on the first groove, and a width of the tapered portion becomes wider toward the second connector.

10. The coaxial connector of claim 6, wherein a fastening block that is arranged at a rear end of the second housing and is coupled to the moving housing in a way that makes the moving housing movable.

* * * * *